United States Patent [19]

Addudle et al.

[11] Patent Number: 4,473,125

[45] Date of Patent: Sep. 25, 1984

[54] INSERT FOR DRILL BITS AND DRILL STABILIZERS

[75] Inventors: Larry S. Addudle, Lake Villa, Ill.; Donald E. Andrews, Hammond, La.

[73] Assignee: Fansteel Inc., N. Chicago, Ill.

[21] Appl. No.: 442,280

[22] Filed: Nov. 17, 1982 (Under 37 CFR 1.47)

[51] Int. Cl.[3] ..... E21B 10/46

[52] U.S. Cl. ..... 175/410; 175/39

[58] Field of Search ..... 407/118, 120; 76/108 A, 76/101 A; 175/410, 374, 375, 39

[56] References Cited

U.S. PATENT DOCUMENTS

| | | | |
|---|---|---|---|
| 2,489,687 | 11/1949 | Thrift et al. | 175/39 |
| 2,641,446 | 6/1953 | Haglund et al. | 175/410 |
| 3,581,835 | 6/1971 | Stebley | 76/108 A |

FOREIGN PATENT DOCUMENTS

| | | | |
|---|---|---|---|
| 1065878 | 1/1954 | France | 175/410 |
| 618525 | 8/1978 | U.S.S.R. | 175/39 |

*Primary Examiner*—Stephen J. Novosad
*Assistant Examiner*—William P. Neuder
*Attorney, Agent, or Firm*—Barnes, Kisselle, Raisch, Choate, Whittemore & Hulbert

[57] ABSTRACT

A hard metal wear insert to be force fitted into a steel body of a tool or stabilizer which has a serrated cylindrical side surface, as in the prior art, but is provided with air relief passages on the sides to relieve air in the receiving recess as the insert is driven in. A diametrical cross-passage between the air relief passages aids in the expulsion of air and provides a fracture line for destructive removal of the inserts. A central axial passage in conical form allows ready inspection of progressive wear as well as functioning to vent the interior end to prevent excessive air pressure in the heating of the body. A receiving recess in the body is shaped to provide a bottom surface to seat the insert solidly while permitting the air relief passages to function.

6 Claims, 6 Drawing Figures

INSERT FOR DRILL BITS AND DRILL STABILIZERS

FIELD OF INVENTION

Earth and rock drilling equipment in which small cylindrical hard metal inserts are seated in surface recesses to increase the wear characteristics of drills and drill string stabilizers.

BACKGROUND OF INVENTION

Earth drilling tools utilize large bits or drill heads formed of solid steel used in a rotative or rotative and percussion action to drill earth and rock and other geological formations.

Percussion drilling is widely used for drilling blast holes in mining and quarrying. Earth boring machines are employed which serve to rotate and reciprocate a percussion tool to which a drill head is attached. For example, a percussion tool may be rotated at about 20 r.p.m., and it may be reciprocated in short strokes of about 4 to 5 inches to produce 500 to 800 impacts per minute. To provide a satisfactory wear life for a drill head, cylindrical recesses are formed in the surface and hard metal inserts are forced into these holes to leave the ends projecting. These inserts, usually formed of tungsten carbide, are supported on the drill head and provide long wearing qualities in comparison to the solid steel heads. Examples of this type of drill head are found in two patents to Frank E. Stebley, U.S. Pat. No. 3,382,940 (May 14, 1968) and U.S. Pat. No. 3,603,414 (Sept. 7, 1971). These patents show drill heads and wear inserts introduced into recesses in the surface. See also the U.S. Pat. to Ott, No. 3,389,761 (June 25, 1968).

In deep earth drilling used in oil well exploration, another use is found for hard metal inserts. Drill pipe may extend into the earth thousands of feet. In most drilling operations, drill string stabilizers are used to prevent excessive wear on the drill pipe and to stabilize the long drill string which is being rotated. These drill stabilizers are generally one piece forgings six to eight inches in diameter and about eighteen inches in length. They are formed with a wide spiral land and groove configuration. The spiral land is provided with multiple radial surface holes into which are introduced tungsten carbide inserts having a protruding nose portion to serve as a wear element to increase the overall life of the stabilizer. These stabilizers are introduced into the drill string at appropriate intervals separated by drill collars and drill pipe. Various spacings will depend on the geological make up of the earth in a particular drilling site.

The present invention relates to the inserts which are utilized in the above-described drilling operations. A cylindrical insert with a serrated side wall has been used as the wear element. This insert is driven into holes in the carrying body in an interference fit and has such a tight fit that air behind the insert is compressed. In order to compensate for this compression, the receiving holes have been drilled twice as deep as the length of the insert. After the carrying body, such as a stabilizer, is worn, the inserts are removed by heating the host body. On occasion the trapped air would expand and project the inserts out like a rifle bullet. This has necessitated the heating in a cage to reduce risk to the operators.

Another problem in connection with these devices has been the difficulty in determining wear on the inserts. It could only be estimated by the time in service or by actual measurement which is time consuming and inconvenient.

It is an object of the invention to provide an improved insert design which eliminates some of the problems inherent in the use of the prior art inserts and which has additional advantages.

It is a specific object to provide an insert which can be driven in to a receiving recess without compressing the air in the recess. Accordingly, the recess can be fitted to the insert and provide a solid bottom support. It is a further object to provide an insert which has a built-in wear indicator which serves not only to indicate wear but also as a relief port when inserts are to be removed by heating the host body. Another optional feature is the provision of a break groove to facilitate insert removal. A benefit of the proposed design lies in an insert with less material, thus an economic savings, and no loss in effective wear characteristics.

Other objects and features of the invention will be apparent in the following description and claims, in which the invention is described together with details directed to persons skilled in the pertinent arts to enable the invention to be practiced in accordance with the disclosure, all in connection with the best mode presently contemplated for the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Figure 1:
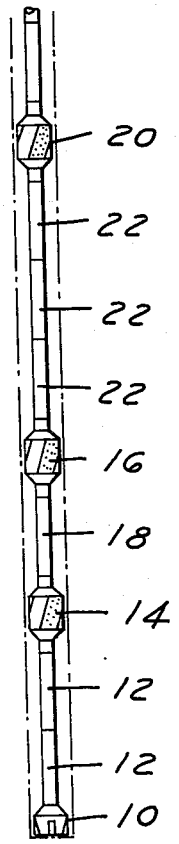
FIG. 1, a view of an oil drill string with stabilizers.
Figure 2:
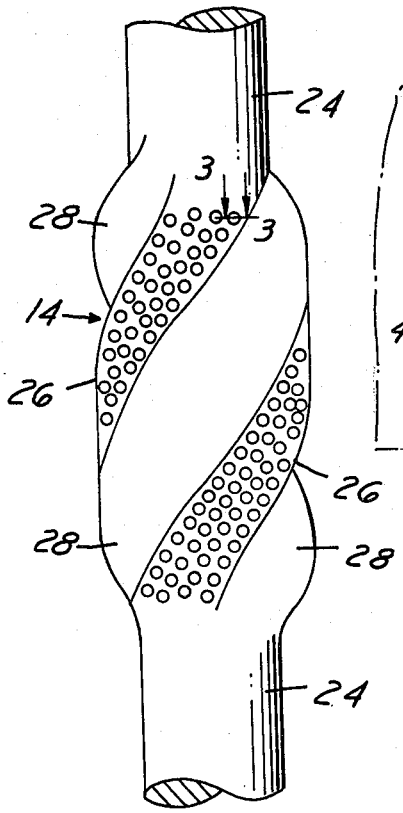
FIG. 2, an enlarged view of a drill collar stabilizer.

With reference to the drawings, in FIG. 1, a drill string is depicted as an example of the use of the insert to be described. A drill 10 is connected by two 30-foot drill collars 12 to a stabilizer body 14. A second stabilizer 16 is connected by a drill collar 18 and a third stabilizer 20 is connected by three drill collars 22. The stabilizer body 14, as shown in FIG. 2, has two connecting ends 24 on either side of an enlarged body portion formed by spiral lands 26 separated by flutes 28. The lands have a plurality of blind holes disposed radially to the rotative axis of the body 14 as shown in FIGS. 2 and 3.

Figure 3:
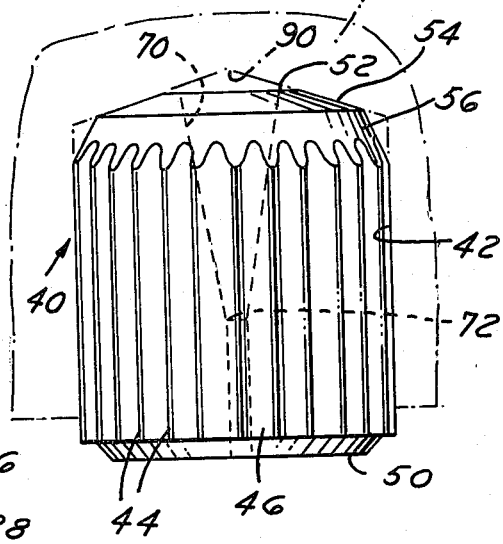
FIG. 3, a side elevation of an improved wear insert.
Figure 4:
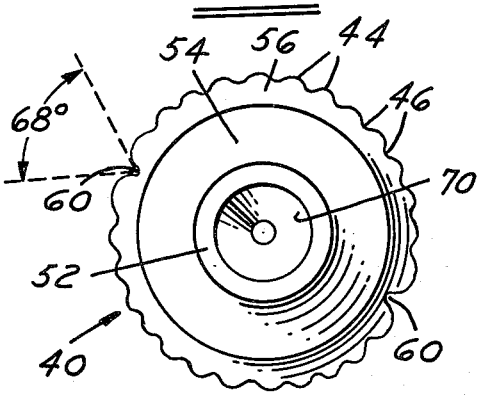
FIG. 4, an end view of the bottom of an insert.

In FIG. 3, an insert 40 is illustrated within a hole 42 in a land 26. The insert, by way of example, is about 0.582" in outside diameter but has a cylindrical wall which has serrations to a depth of 0.019". The crests 44 of the serrations are 15° apart on the OD with a 0.010" radius at the valley 46 of the serration and a 0.015" radius at the crest as illustrated in FIG. 4. At the top (or outer projection end) of the insert is a crown 50 with a 45° bevel and extending above the serrations about 0.015".

Figure 5:
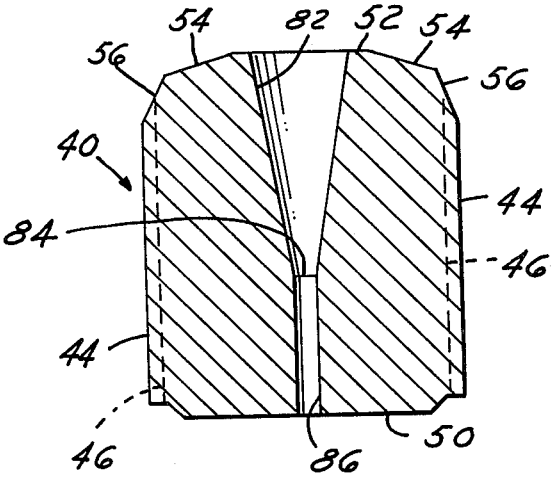
FIG. 5, a sectional view on centerline of a modified insert.

The base (or inner seated end) of the insert 40 is centrally flat at 52 but has a double angled surface as illustrated in FIGS. 3 and 5. Around the central portion is an annular seat portion 54 on a conical included angle of 150°. Outside this portion 54 is a conical annular portion 56 having an included angle of 50°. This portion 56 angles into the bottom (or valley) 46 of the serrations 44.

The dimensions given in this description are by way of example and may be varied without departing from the basic concepts of the invention.

In addition to the serrations, two diametrically opposed grooves 60, substantially larger than the serrations, are provided with a 68° included angle and a depth of about 0.040" as shown in FIG. 4. These grooves are for air relief from the receiving recess as the insert is driven into the stabilizer body land 26. The serrations are such, in relation to the diameter of the recess into which the insert is received, that there is an interference fit and air cannot escape through the serrations. The larger grooves provide for the air escape so that it is not compressed in the bottom of the hole.

Figure 6:
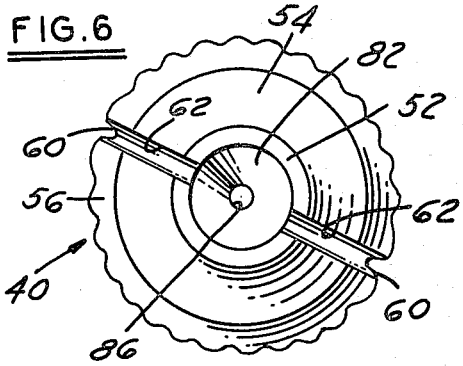
FIG. 6, a bottom end view of a second modified insert.

In FIG. 6, a diametrical transverse groove 62, between grooves 60, of about the same angle and depth as grooves 60, is provided in the bottom of the insert. This provides an additional air relief passage and has another function which will be described later.

A conical central recess 70 in the bottom (inner end) of the insert 40 is shown in dotted lines in FIG. 3. This recess has an included angle of 20° and is frustroconical in that it terminates at 72 about two-thirds of the axial length of the insert. The function of this recess is to indicate wear of the insert. The stabilizer body land 26 and the insert both wear in use. When the opening 70 becomes visible at the outer end, an operator will know that the insert has worn down to about two-thirds of its original length. By measuring the diameter of the conical recess as wear progresses, the operator will have an accurate reading on the extent of wear.

In FIG. 5, there is shown an insert 80 having a conical recess 82 which truncates at 84 and then proceeds as a straight bore or passage 86 to the outer end of the insert. In this insert air relief is provided directly through the center so that pressure cannot build up at the inner end of the insert as it is driven into the steel body. In addition, this recess also provides a wear indicator as described in connection with the embodiment of FIG. 3. The recess also provides entrance for a removal tool if this is desired.

In the embodiment of FIG. 6, the insert combines the relief grooves 60, the recess 82 and passage 86, and the transverse groove 62. All of these grooves and recesses reduce the amount of expensive tungsten carbide required and thus reduce the cost of the material used in the insert without affecting the effectiveness of the insert as a wear part.

The groove 62, previously referenced as functioning to connect the side relief passages 60, also may serve along with side grooves 60 as a notch or fracture groove if it is desired to crack the insert to facilitate removal. The relief passages avoid the possibility of the inserts blowing out during repair when the body is heated and even the need for heating the body can be avoided when the grooves are used to facilitate fracturing of the inserts for removal. The feature of ready wear inspection has been mentioned.

As shown in FIG. 3, base 90 of the hole 42 in the land to receive the insert can be drilled with a drill end having an end with an included angle similar to the inner end of the insert. Thus, the base 54 of the insert can seat solidly in the base of the hole 42 and not on a cushion of air as in the prior art. In addition, the depth of such drilling can match that of the distance that the inserts seat firmly into the holes, rather than requiring a hole depth about twice that of the insert seating depth as in the prior art. This results in a substantial cost savings in hole drilling in the stabilizer body, provides a positive and firm seat for the seats, and causes less reduction in the strength and rigidity of the stabilizer body because of the lesser quantity of metal removed in hole drilling.

It will be appreciated that, while the above disclosure has emphasized the use in stabilizer bodies, the inserts could also be used in rotating drilling heads.

We claim:

1. An insert for a rotatable body used in earth drilling comprising a generally cylindrical body of a hard, wear resistant material having a side surface cylindrical about a central axis and two end surfaces, with a first of said end surfaces adapted to be exposed and a second of said end surfaces to be innermost when the insert is driven into a blind hole, said insert having one or more air relief grooves extending between the ends having a depth such that the base of the grooves will be spaced from the wall of the recess when the insert is driven into the recess whereby air in the recess may escape through said one or more grooves as the insert is installed, and a diametrically positioned groove formed in the second end of said insert connecting the said one or more air relief grooves in the side surface.

2. An insert as defined in claim 1 in which said insert has a central conical recess in said second end, the base of said recess intercepting said diametrically positioned groove, the conical recess extending into said insert in a converging wall toward the other end of said insert, said conical recess serving as a wear indicator as the outer end of said insert abrades down to the end of the conical recess and also as an air relief passage when said body is heated to remove said insert.

3. An insert for a rotatable body used in earth drilling comprising a generally cylindrical body of a hard, wear resistant material having a side surface cylindrical about a central axis and two end surfaces, with a first of said end surfaces adapted to be exposed and a second of said end surfaces to be innermost when the insert is driven into a blind hole, said insert having one or more air relief grooves extending between the ends having a depth such that the base of said one or more grooves will be spaced from the wall of the recess when the insert is driven into the recess whereby air in the recess may escape through said one or more grooves as the insert in installed, said insert having a central conical recess in said second end extending into said insert in a converging wall toward the other outer end of said insert, said recess serving as a wear indicator as the outer end of said insert abrades down to the end of said recess and also as an air relief passage when said body is heated to remove said insert.

4. An insert as defined in claim 3 in which said conical recess connects at the inner apex end to a central axial passage of uniform cross-section extending to the first end of said insert.

5. An insert for a rotatable body used in earth drilling comprising a generally cylindrical body of hard, wear resistant material having a side surface cylindrical about a central axis and two end surfaces, with a first of said end surfaces adapted to be exposed and a second of said end surfaces to be innermost when the insert is driven into a blind hole, said insert having a central conical recess in said second end extending into said insert in a converging wall toward the other outer end of said insert, said recess serving as a wear indicator as the outer end abrades down, and a central passage from the end of said conical recess to said first end to serve as an air relief passage during the introduction of said insert into said blind hole.

6. An insert as defined in claim 5 in which a diametrically positioned groove is formed in the second end of said insert in communication with said conical recess.

* * * * *